US006227989B1

(12) United States Patent
Reid

(10) Patent No.: US 6,227,989 B1
(45) Date of Patent: May 8, 2001

(54) SPORTS FIELD LINE MARKING SYSTEM

(76) Inventor: Michael Reid, J-572, 3425 - 40 Avenue, S.W., Calgary, Alberta (CA), T3E 6W1

( * ) Notice: Subject to any disclaimer, the term of this patent is extended or adjusted under 35 U.S.C. 154(b) by 0 days.

(21) Appl. No.: 09/305,441

(22) Filed: May 6, 1999

(30) Foreign Application Priority Data

May 16, 1998 (CA) ..... 2237046

(51) Int. Cl.[7] ..... A63B 61/00

(52) U.S. Cl. ..... 473/490; 473/191; 47/33; 15/217

(58) Field of Search ..... 473/171, 278, 473/490, FOR 171, FOR 278, FOR 490; 428/17; 47/1.01 R, 1.01 F, 33; 273/DIG. 8, DIG. 13; 404/7, 8, 12; 15/217

(56) References Cited

U.S. PATENT DOCUMENTS

| | | | | |
|---|---|---|---|---|
| 1,961,580 | * | 6/1934 | Brown | 404/12 |
| 3,157,557 | * | 11/1964 | Palmer | 473/171 |
| 3,467,391 | * | 9/1969 | Elesh | 473/278 |
| 3,513,062 | * | 5/1970 | Vinicki | 473/171 |
| 3,995,079 | * | 11/1976 | Haas, Jr. | 473/278 |
| 4,023,506 | | 5/1977 | Robey . | |
| 4,044,179 | * | 8/1977 | Haas, Jr. | 473/490 |
| 4,103,886 | * | 8/1978 | Eley | 473/490 |
| 4,218,059 | | 8/1980 | Elden . | |
| 4,429,872 | | 2/1984 | Capachi . | |
| 4,755,401 | * | 7/1988 | Friedrich et al. | 273/DIG. 13 |
| 4,832,331 | | 5/1989 | Brandli . | |
| 4,946,719 | * | 8/1990 | Dempsey | 273/DIG. 13 |
| 5,158,282 | | 10/1992 | Winter . | |
| 5,371,949 | | 12/1994 | Delaurier . | |
| 5,586,408 | * | 12/1996 | Bergevin | 47/1.01 R |
| 5,613,855 | | 3/1997 | Thompson et al. . | |
| 5,830,080 | * | 11/1998 | Reynolds | 273/DIG. 8 |

FOREIGN PATENT DOCUMENTS

| | | |
|---|---|---|
| 174389 | 12/1916 | (CA) . |
| 1101455 | 6/1978 | (CA) . |
| 1074355 | 3/1980 | (CA) . |
| WO 95/12441 | 11/1995 | (WO) . |

* cited by examiner

*Primary Examiner*—Stephen F. Gerrity
*Assistant Examiner*—Mitra Aryanpour
(74) *Attorney, Agent, or Firm*—Bennett Jones LLP

(57) ABSTRACT

A line marking system for installing permanent field lines in natural grass fields is disclosed. The system comprises a line fixed to a backing sheet which is installed under the grass sod. The backing sheet is preferably a mesh which allows the grass to grow through the backing sheet thereby anchoring the line to the ground.

8 Claims, 1 Drawing Sheet

SPORTS FIELD LINE MARKING SYSTEM

FIELD OF THE INVENTION

The present invention relates to a system for permanently marking visible lines in natural turf.

BACKGROUND OF THE INVENTION

Many outdoors sports played on natural grass require lines by drawn to indicate boundaries and other field markings. Conventionally, such lines are marked by chalk or paint to create the line on the grass.These conventional techniques suffer from the drawback that the line markings are temporary and must be reapplied from time to time. Also, contestants may run over the lines and obliterate them during the game. Alternatively, the lines may be created by using diesel or other chemicals to kill the grass which is environmentally unacceptable.

There have been attempts to create permanent line markers such as that disclosed in U.S. Pat. No. 4,832,331 issued to Brandli, May 23, 1989. The field marker disclosed in this patent comprises a narrow strip of material which is a base to which a plurality of pegs are attached. The base is then buried in a trench so that the tops of the pegs are visible above the ground. This field marker is somewhat unstable because of the narrowness of the base and the fact that it is held in place only by a thin layer of soil over the base.

Therefore, there is a need in the art for an artificial line marking system which is permanent, resists unwanted shifting or movement, is environmentally friendly and which provides a consistent level playing surface with the surrounding natural grass.

SUMMARY OF THE INVENTION

In one aspect of the invention and in general terms, the invention comprises a system for permanently marking visible lines in natural turf, said system comprising:

(a) an elongate backing sheet defining a plurality of openings; and (b) an elongate line associated with the backing sheet, wherein said line is narrower than and aligned with the backing sheet and wherein said line provides a visible contrast with the natural turf;

wherein the backing sheet may be buried slightly beneath the surface of the natural turf such that the line is substantially level with the level of the turf and occupies a channel cut in the turf.

In another aspect of the invention and again in general terms, the invention comprises a method of marking a permanent artificial line in natural turf, said method comprising the steps of:

(a) cutting and removing a sod strip from the turf in the position intended for the line;

(b) undercutting but not removing the sod immediately adjacent to the removed sod strip;

(c) inserting a line marker-backing sheet combination of the type described above such that the backing sheet is inserted underneath the undercut sod and the line marker is positioned in the space left by the removed sod strip substantially level with the adjacent turf.

Preferably, the method comprises the further step of allowing the undercut sod to reroot itself through the plurality of openings in the backing sheet thereby securing the backing sheet to the turf.

Alternatively, if the artificial lines are to be installed in a new field installation where new sod is being laid, then the step of cutting existing sod is not necessary. The backing sheet is simply laid in position and new sod is laid over the backing sheet so as to closely abut the line marker on each side.

DETAILED DESCRIPTION OF THE INVENTION

The present invention was developed with the intention that it be applied to existing sports field such as baseball diamonds, soccer and football fields and golf courses. However, it will be apparent that the invention is not limited to such applications. Rather, the invention may be practiced in any application where a permanent line marker in a grass field is necessary or desirable. For example, lines on a grass airport runway may be created using the present invention.

Figure 1:
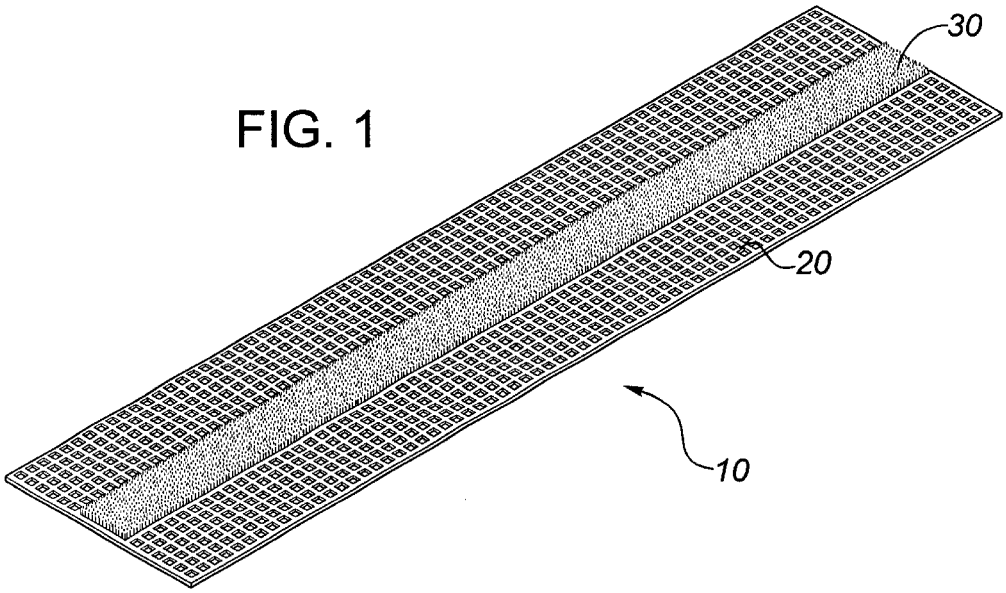
FIG. 1 is a pictorial view of an embodiment of the invention, prior to installation.
Figure 2:
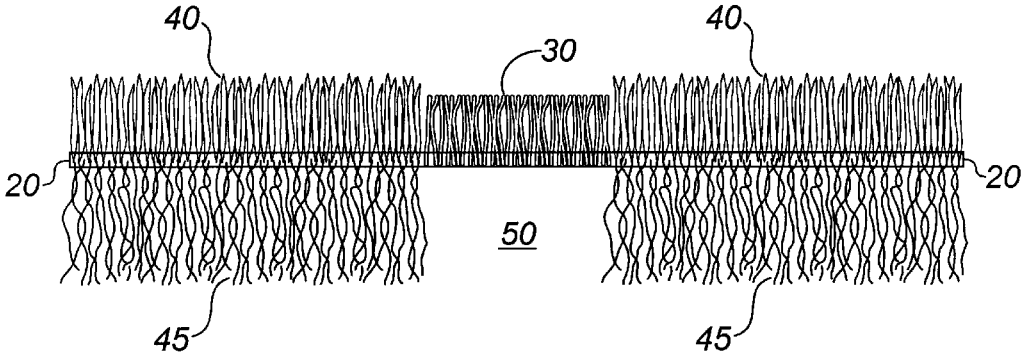
FIG. 2 is a cross-sectional view of an embodiment of the invention, installed in natural turf.

In its physical form as shown in FIG. 1, the invention (10) comprises an elongate backing sheet (20) to which a line (30) is affixed. The line (30) is narrower than the backing sheet (20), allowing the backing sheet (20) to be buried while the line (30) remains visible.

In its simplest form, the backing sheet (20) may be formed of any porous sheet-like material possessing sufficient strength to anchor the line (30) and through which the grass (40) adjacent the line (30) may reroot itself. Many woven fabrics or wire meshes may be suitable for this purpose. In the preferred embodiment, the backing sheet (20) is a mesh fashioned from poured rubber or polyurethane. The mesh should be fine enough to permanently anchor the backing sheet (20) in the soil (50) but not so fine as to prevent growth of the grass roots (45) through the mesh, which will anchor the backing sheet (20).

The line (30) may be fashioned from a strip of any material which is durable, may be affixed to the backing sheet (20) and which provides a visible contrast from the turf. In its simplest form, the line (30) may be a strip of white synthetic pile material which is glued to the backing sheet (20). Alternatively, the line (30) may be actually woven into the backing sheet (20) using well-known carpet construction techniques such as needle punch construction or tufted construction.

Preferably, the line (30) material should be durable and resistant to fading as a result of ultraviolet light exposure. Also, it is preferable that the material be somewhat similar to natural turf in traction and resilience where this system is used in applications where participants will step on the line (30), such as baseball, soccer or football fields. A wide range of synthetic fibres are suitable for this purpose and are well-known in the art of artificial turf or outdoor carpets.

It is also preferable that the line (30), once affixed to the backing sheet (20), completely block out sunlight. This will prevent grass (40) from growing through the backing sheet (20) and intermingling with the line (30).

It is of course convenient to use elongate lengths of the backing sheet (20) and line (30) combination to simplify the installation procedure. While actual dimensions are not critical or essential to this invention (10) as claimed below, the preferred embodiment comprises 10 foot lengths of the backing sheet (20). The width of the backing sheet (20) is preferably the width of the line (30) plus an additional 3 to 7 inches on either side of the line (30). Thus, if a line (30) which is 2 inches wide is used and greater stability is desired, the backing sheet (20) may be made 16 inches wide.

The line (30) and backing sheet (20) combination may be installed by cutting and removing a 2 inch wide strip of sod and undercutting the adjacent sod to a width of 7 inches on either side of the channel. The depth of the cut should be controlled so as to position the line (30) substantially level with the adjacent sod. The cutting may be done manually or by using a modified sod cutter. Of course, if the invention (10) is installed in a new field installation, without existing turf, then no sod cutting steps are necessary. The backing sheet (20) is simply laid into position and new sod is installed over the backing sheet (20) so as to abut the line (30).

Once the sod strip has been cut and the undercut sod is peeled back but not removed, the backing strip may be laid down on the soil (50) and positioned so that the line (30) is aligned with the removed sod strip. The undercut sod is then replaced over the backing sheet (20). The edges of the sod will then be immediately adjacent the line (30) and substantially level with the line (30). Over time, the undercut sod will grow through the backing sheet (20) which will anchor it firmly to the ground, thereby firmly anchoring the line (30) into position.

As will be apparent to those skilled in the art, various modifications, adaptations and variations of the foregoing specific disclosure can be made without departing from the scope of the present invention.

The embodiments of the invention in which an exclusive property or privilege is claimed are defined as follows:

1. An artificial line marker for permanently marking visible lines in natural turf, said marker comprising:

(a) an elongated planar backing sheet defining a plurality of openings; and (b) an elongated line attached to the backing sheet, wherein said line is narrower than and aligned with the backing sheet and wherein said line is composed of artificial turf material and is woven into the backing sheet, the line is adapted to provide a visible contrast with the natural turf;

wherein the planar backing sheet is adapted to be buried slightly beneath the surface of the natural turf such that the line is substantially level with the level of the turf and occupies a channel cut in the turf and such that grass of the natural turf may root through the backing sheet adjacent to the line.

2. The marker of claim 1 wherein the line is permanently affixed to the backing sheet and is substantially centred on the backing sheet.

3. The marker of claim 1 wherein the backing sheet is comprised of a rubber or polyurethane mesh.

4. An artificial line marker for permanently marking visible lines in natural turf, said marker comprising:

(a) an elongated planar backing sheet defining a plurality of openings; and (b) an elongated line adhered to the backing sheet, wherein said line is narrower than and aligned with the backing sheet and wherein said line is adapted to provide a visible contrast with the natural turf;

wherein the planar backing sheet is adapted to be buried slightly beneath the surface of the natural turf such that the line is substantially level with the level of the turf and occupies a channel cut in the turf and such that grass of the natural turf may root through the backing sheet adjacent to the line.

5. The marker of claim 4 wherein the backing sheet is comprised of a rubber or polyurethane mesh.

6. A method of marking a permanent artificial line in natural turf, said method comprising the steps of:

(a) cutting and removing a sod strip from the turf in the position intended for the line;

(b) undercutting but not removing the sod immediately adjacent to the removed sod strip, (c) inserting into the void left by the removed sod strip an artificial line marker comprising an elongate backing sheet defining a plurality of openings and an elongate line associated with the backing sheet, wherein said line is narrower than and aligned with the backing sheet and wherein said line provides a visible contrast with the natural turf such that the backing sheet is inserted underneath the undercut sod and the line is positioned in the space left by the removed sod strip substantially level with the adjacent turf; and (d) allowing the undercut sod to root through the backing sheet openings.

7. The method of claim 6 further comprising the step of allowing the undercut sod to reroot itself through the plurality of openings in the backing sheet thereby securing the backing sheet to the turf.

8. A method of marking a permanent artificial line while installing grass sod, said method comprising the steps of:

(a) laying down an artificial line marker comprising an elongate backing sheet defining a plurality of openings and an elongate line associated with the backing sheet, wherein said line is narrower than and aligned with the backing sheet and wherein said line provides a visible contrast with the natural turf onto earth which has been prepared for grass sod installation;

(b) installing grass sod over the backing sheet and abutting the line marker on one or both sides of the line marker such that the sod is substantially level with the line marker; and (c) allowing the grass sod to grow through the plurality of openings in the backing sheet thereby securing the backing sheet.

* * * * *